US009650852B2

(12) United States Patent
Arnt

(10) Patent No.: US 9,650,852 B2
(45) Date of Patent: May 16, 2017

(54) RUNNING AND PULLING TOOL FOR USE WITH ROTATING CONTROL DEVICE

(71) Applicant: HALLIBURTON ENERGY SERVICES, INC., Houston, TX (US)

(72) Inventor: Anton Kelley Arnt, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/026,144

(22) PCT Filed: Aug. 7, 2015

(86) PCT No.: PCT/US2015/044318
§ 371 (c)(1),
(2) Date: Mar. 30, 2016

(87) PCT Pub. No.: WO2016/032728
PCT Pub. Date: Mar. 3, 2016

(65) Prior Publication Data

US 2016/0245028 A1 Aug. 25, 2016

Related U.S. Application Data

(60) Provisional application No. 62/042,505, filed on Aug. 27, 2014.

(51) Int. Cl.
*E21B 23/00* (2006.01)
*E21B 33/08* (2006.01)
*E21B 3/02* (2006.01)

(52) U.S. Cl.
CPC ..... *E21B 23/00* (2013.01); *E21B 3/02* (2013.01); *E21B 33/085* (2013.01)

(58) Field of Classification Search
CPC ..... E21B 23/00; E21B 3/02; E21B 33/085; E21B 21/08; E21B 23/02; E21B 34/16;
(Continued)

(56) References Cited

U.S. PATENT DOCUMENTS 2,776,015 A * 1/1957 Biclstein ..... E21B 23/02 138/89
3,007,526 A 11/1961 Tausch
(Continued)

FOREIGN PATENT DOCUMENTS

WO 2012041996 A2 4/2012

OTHER PUBLICATIONS

International Search Report and Written Opinion issued in related PCT Application No. PCT/US2015/044318 mailed on Oct. 26, 2015 (14 pages).

*Primary Examiner* — Yong-Suk (Philip) Ro
(74) *Attorney, Agent, or Firm* — John W. Wustenberg; Baker Botts L.L.P.

(57) ABSTRACT

A pulling tool is used for setting or removing an internal component of a rotating control device (RCD). The pulling tool includes keys that extend outward for engaging with an inner surface of the internal component. The keys are spring loaded so that as the pulling tool is pressed through the internal component, the keys collapse inward until the keys are moved into a mating internal groove profile on the inner surface of the component. The pulling tool is able to selectively engage with and release from the component, both when the component is disposed in the RCD and when outside the RCD. This facilitates a mechanized installation and/or removal of the internal component from the RCD without relying on a friction force and without applying a torque or providing hydraulic fluid to the pulling tool.

19 Claims, 16 Drawing Sheets

(58) Field of Classification Search
CPC ..... E21B 44/00; E21B 21/001; E21B 7/12; E21B 41/0007; E21B 19/004; E21B 2021/006
See application file for complete search history.

(56) References Cited

U.S. PATENT DOCUMENTS

| | | | | |
|---|---|---|---|---|
| 3,335,802 | A * | 8/1967 | Seyffert, III | E21B 23/02 166/214 |
| 4,019,579 | A | 4/1977 | Thuse | |
| 4,436,152 | A | 3/1984 | Fisher, Jr. et al. | |
| 4,540,048 | A | 9/1985 | Gazda | |
| 4,591,197 | A | 5/1986 | Akkerman | |
| 4,813,495 | A | 3/1989 | Leach | |
| 5,183,114 | A | 2/1993 | Mashaw, Jr. et al. | |
| 7,926,593 | B2 | 4/2011 | Bailey et al. | |
| 8,322,432 | B2 | 12/2012 | Bailey et al. | |
| 8,381,816 | B2 | 2/2013 | Leduc et al. | |
| 8,408,297 | B2 | 4/2013 | Bailey et al. | |
| 8,701,796 | B2 | 4/2014 | Bailey et al. | |
| 2005/0241833 | A1 | 11/2005 | Bailey et al. | |
| 2008/0210471 | A1 * | 9/2008 | Bailey | E21B 21/08 175/48 |
| 2011/0036638 | A1 | 2/2011 | Sokol et al. | |
| 2012/0000664 | A1 | 1/2012 | Nas et al. | |
| 2012/0085545 | A1 | 4/2012 | Tarique et al. | |
| 2013/0206386 | A1 | 8/2013 | Bailey et al. | |

* cited by examiner

RUNNING AND PULLING TOOL FOR USE WITH ROTATING CONTROL DEVICE

CROSS REFERENCE TO RELATED APPLICATION

This application is a U.S. National Stage Application of International Application No. PCT/US2015/044318 filed Aug. 7, 2015, which claims the benefit of U.S. Provisional Application No. 62/042,505, entitled "RUNNING AND PULLING TOOL FOR USE WITH ROTATING CONTROL DEVICE" and filed Aug. 27, 2014, both of which are incorporated herein by reference for all purposes

TECHNICAL FIELD

The present disclosure relates generally to downhole drilling operations and, more particularly, to a pulling tool designed to install and/or remove a packing element or bearing assembly from a rotating control device (RCD).

BACKGROUND

Drilling operations may be performed in a variety of locations and settings. Some drilling operations may be performed on land, where a wellbore can be formed by drilling through rock directly beneath a drilling system. Some drilling operations may be performed offshore, such that a wellbore can be formed by first passing through water and then drilling through the seabed. When drilling, a gap (typically referred to as an annulus) may be present between the drill string and the casing and/or outside of the wellbore. In some drilling operations, the annulus may be closed during drilling operations. Some closed annulus drilling operations may include Managed Pressure Drilling (MPD), underbalanced drilling, mud cap drilling, air drilling, and mist drilling.

When performing closed annulus drilling operations, a rotating control device (RCD), also referred to as a rotating drilling device, rotating drilling head, rotating flow diverter, pressure control device, rotating blow out preventer, and rotating annular, may be used to divert drilling fluids returning from the well. The drilling fluids may be diverted into separators, chokes and other equipment. The RCD may function to close off the annulus around a drill string during drilling operations. The sealing mechanism of the RCD, typically referred to as a seal element or packing element (packer), is operable to maintain a dynamic seal on the annulus. More specifically, the packing element is sealed onto the drill string such that, as the drill string rotates, the packing element rotates as well, driving rotation of an inner mandrel relative to a static outer housing of a bearing assembly. When the packing element or bearing assembly become worn with continued use, it is desirable to remove the old packing element or bearing assembly and to insert in a new or repaired component.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Figure 1:
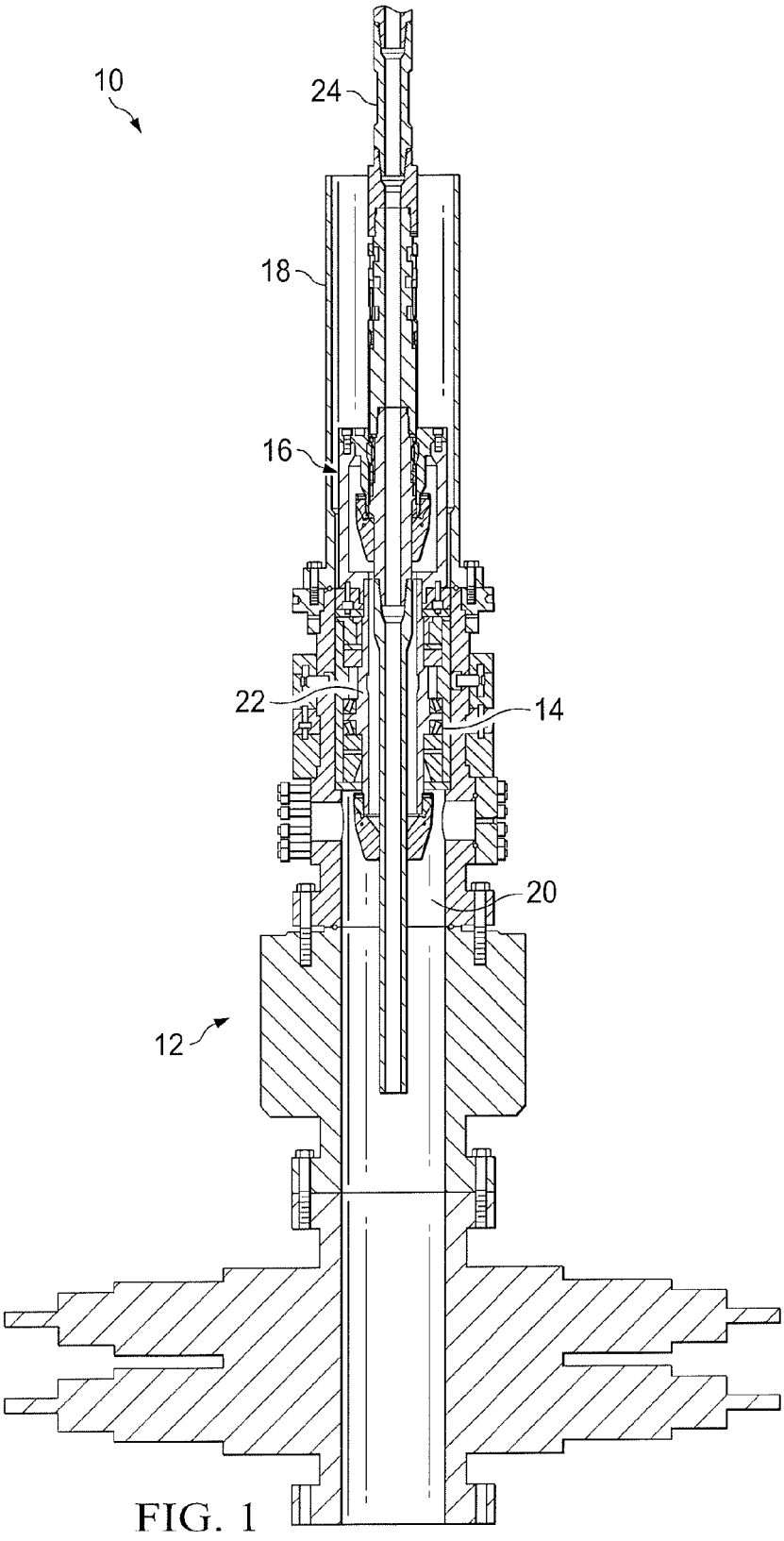
FIG. 1 is a schematic cross sectional view of a pulling tool in a rotating control device (RCD), in accordance with an embodiment of the present disclosure.

Example embodiments of the present disclosure are described in detail herein. In the interest of clarity, not all features of an actual implementation are described in this specification. It will of course be appreciated that in the development of any such actual embodiment, numerous implementation specific decisions must be made to achieve developers'specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure.

Embodiments described herein are directed to a pulling/running tool that may be used to install or remove an internal component from a rotating control device (RCD) used in oil and gas drilling operations. RCDs are frequently used to provide safety barriers during standard overbalanced drilling applications. In addition, the RCDs are used in underbalanced and managed pressure drilling systems, both onshore and offshore.

In common RCD designs, a packing element is sealed against a drill string. As the drill string rotates, friction against the seal drives rotation of the packing element, which drives rotation of an inner mandrel relative to a static outer housing of a bearing assembly. The bearing assembly and/or packing element may be removably clamped or latched into a body of the RCD, which may be in turn flanged to the top of a blow-out preventer (BOP) stack. As the bearing assembly and/or packing element wear or leak during use, they may be removed and either replaced or repaired for re-installation into the body for continued drilling operations.

In existing systems, the bearing assembly and/or packing unit is generally installed and removed using a drill pipe tool joint, relying on the friction of the packing element to grip the tool joint. However, if mud cakes or other impediments are present in the body of the RCD, it may be useful to apply more force beyond packing element friction to run or pull the bearing assembly or packing element. In some cases, the packing element may become damaged to the point where it can no longer provide sufficient friction against a tool joint to remove the bearing assembly/packing element. Given these difficulties, especially in offshore drilling applications, there is a need for an enhanced tool to remotely install and remove an oilfield device.

To that end, the present disclosure describes systems and methods that can be used for installation and removal of an oilfield device from the RCD without relying on friction applied by a packing element of the RCD. Specifically, one or more embodiments of a pulling tool may be used to set a bearing or stripper assembly (e.g., a packing element) into the RCD or to remove the bearing or stripper assembly from the RCD. The pulling tool may include keys that extend outward for engaging with an inner surface of a bearing assembly mandrel or upper stripper housing. The keys may be spring loaded so that as the pulling tool is pressed down through the bearing mandrel or stripper housing, the keys collapse inward against the springs until the keys are moved into a mating internal groove profile on the inner surface of the bearing or stripper. The pulling tool may selectively engage with and release from the bearing or stripper, both when the bearing or stripper assembly is disposed in the RCD and when outside the RCD. This feature may facilitate a mechanized installation and/or removal of the bearing or stripper assembly from the RCD without relying on a friction force applied by a packer element. In addition, the presently disclosed pulling tool may facilitate the installation and removal of internal RCD components without application of torque to the drill string and without the use of hydraulic fluid provided to the pulling tool.

FIG. 1 illustrates an RCD 10 coupled to a blow-out preventer (BOP) stack 12 in accordance with some embodiments of the present disclosure. The RCD 10 may include a bearing assembly 14 and a packing element 16 disposed within a body 18 of the RCD 10. The packing element 16 may include a dual stripper component to seal an annulus 20 in order to maintain pressure within the wellbore during drilling. The bearing assembly 14 enables rotation of a mandrel 22 coupled to the packer element 16 relative to the stationary body 18 of the RCD 10.

In the illustrated embodiment, a pulling tool 24 is disposed in the RCD 10. The pulling tool 24 may be utilized for both pulling out and running in of the bearing assembly 14 and/or the packing element 16. The term "pulling out" or "pulling" refers to raising the pulling tool 24 (and any components coupled thereto) from a position in the RCD 10 or downhole to a position at the surface of the well (outside the RCD 10). This may be accomplished through applying an upward (e.g., backward) axial force via a tubular string coupled to the pulling tool 24 in order to lift the pulling tool 24 from the wellbore. The term "running in" or "running" refers to lowering the pulling tool 24 (and any components coupled thereto) from a position at the surface of the well (outside the RCD 10) to a position in the RCD 10. This may be accomplished through applying a downward (e.g., forward) axial force via the tubular string coupled to the pulling tool 24 in order to lower the pulling tool 24 into the RCD 10.

Figure 2:
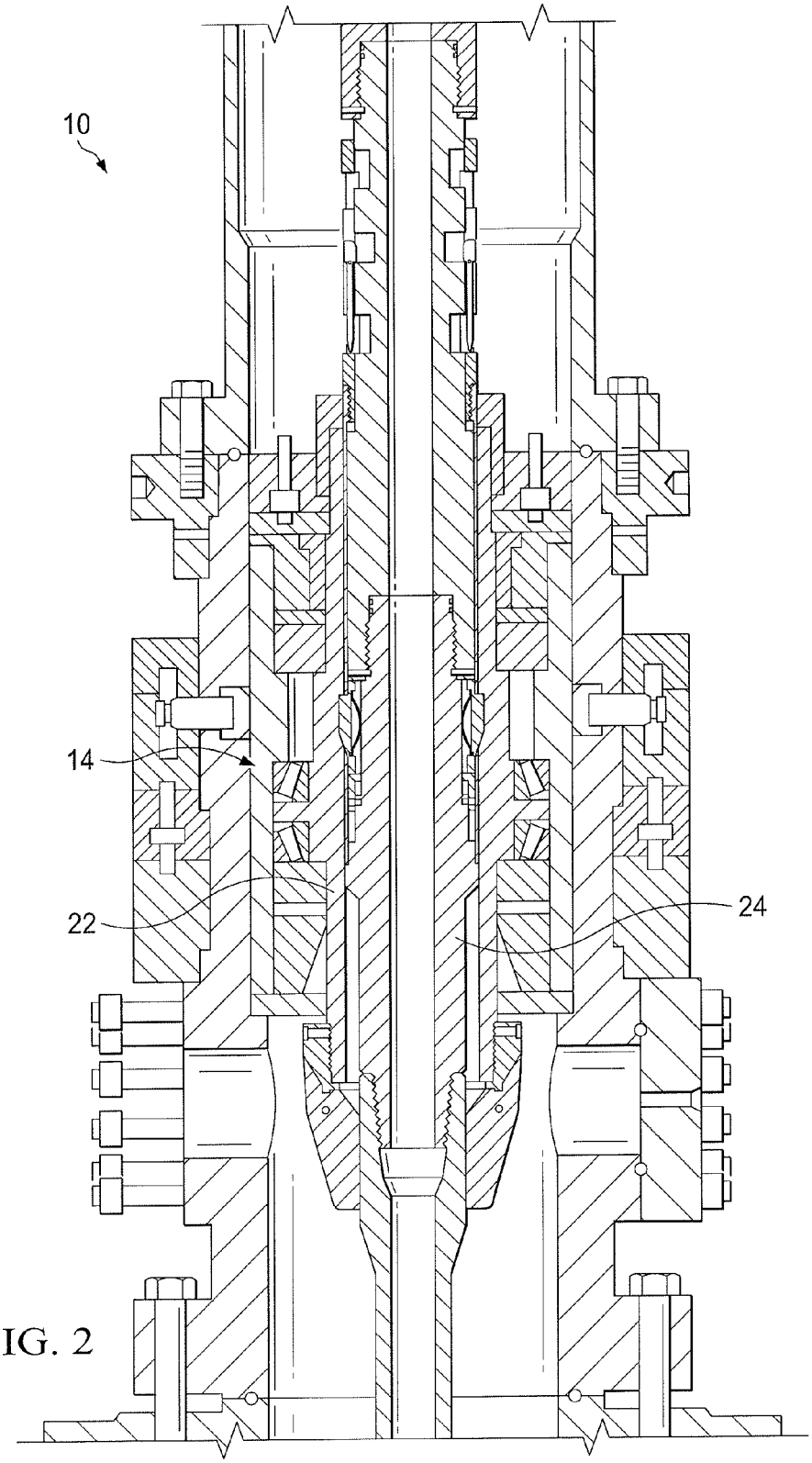
FIG. 2 is a schematic cross sectional view of the pulling tool of FIG. 1 engaged in a bearing assembly of the RCD, in accordance with an embodiment of the present disclosure.
Figure 3:
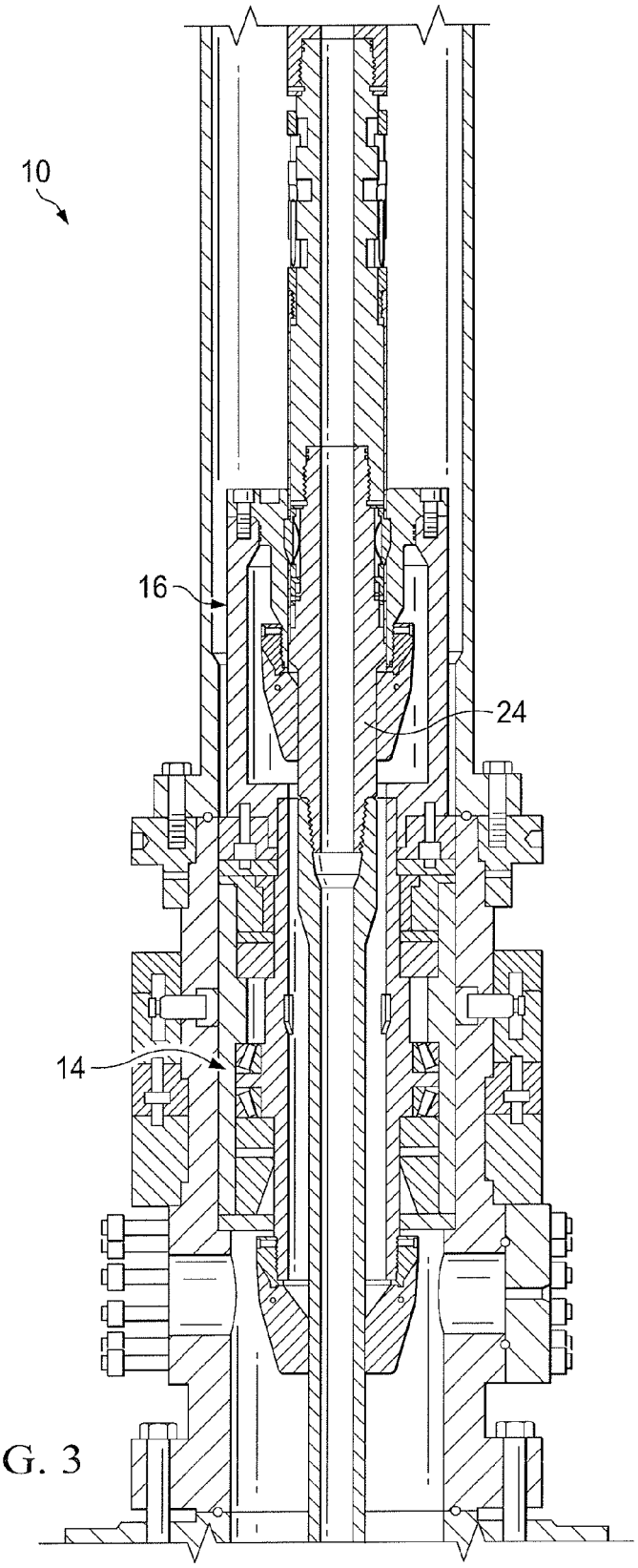
FIG. 3 is a schematic cross sectional view of the pulling tool of FIG. 1 engaged in a packing element of the RCD, in accordance with an embodiment of the present disclosure.

As illustrated in FIG. 2, the pulling tool 24 may selectively engage the bearing assembly 14 of the RCD 10 in order to remove the bearing assembly 14 from the RCD 10 or to insert the bearing assembly 14 into the RCD 10. Similarly, FIG. 3 illustrates the pulling tool 24 selectively engaged with the packing element 16 of the RCD 10 in order to remove the packing element 16 from the RCD 10 or to insert the packing element 16 into the RCD 10. In some embodiments, the bearing assembly 14 may be disposed beneath the packing element 16 in the RCD 10, such that the packing element 16 may be removed from the RCD 10 before the bearing assembly 14 disposed in the RCD 10 can be reached. Likewise, during installation, a bearing assembly 14 may be placed into the RCD 10 before a new or repaired packing element 16 can be positioned and sealed against the RCD 10.

In the illustrated embodiment, the upper packing element 16 may be made up to the bearing assembly 14 such that it cannot be removed separately. For example, in some embodiments, the pulling tool 24, if engaged with the packing element 16, may remove the upper packing element 16, the bearing assembly 14, and a lower packing element at the same time.

Figure 4:
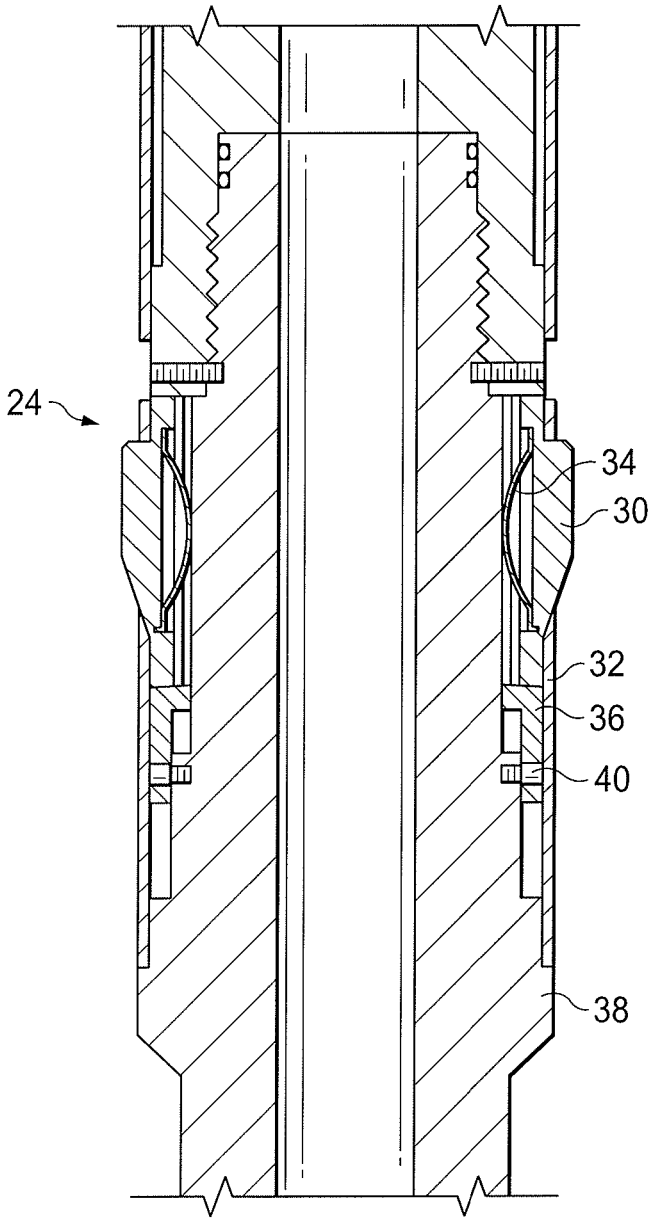
FIG. 4 is a schematic cross sectional view of components of the pulling tool of FIG. 1, in accordance with an embodiment of the present disclosure.

FIG. 4 illustrates one embodiment of the pulling tool 24 that may be used for pulling the bearing assembly 14 and/or packing element 16 out of the body 18 of the RCD 10. As described in detail below, the pulling tool 24 may be entirely mechanically operated. In the illustrated embodiment, the pulling tool 24 includes spring loaded keys 30 that are retained by a slotted outer sleeve 32. The keys 30 may be spring loaded via a bow shaped spring 34. Although in this embodiment, four keys 30 may be present in the pulling tool 24, other embodiments may include any number of keys 30. In some embodiments, it may be desirable to include at least three keys 30 spaced circumferentially about the pulling tool 24. The keys 30 may be supported from below by a shear sleeve 36 (support sleeve), which is pinned into a bottom sub 38 with shear pins 40, as shown in the illustrated embodiment. Although shear pins 40 are illustrated, it should be noted that other embodiments may include shear screws, collet fingers, detents, or anything that allows the supported keys 30 to release and fall under a specified downward force.

In operation, the pulling tool 24 may be made up to a tubular string (e.g., drill string) and run into the mandrel 22 of the bearing assembly 14 or to an upper stripper housing of the packing element 16 with keys 30 in the extended position. In the extended position, the keys 30 extend outward from the bottom sub 38 to a position beyond the outer sleeve 32 and other components of the pulling tool 24. The keys 30 may collapse as the pulling tool 24 enters the bearing assembly mandrel 22 or an upper stripper housing bore of the packing element 16. The keys 30 may extend into a mating internal groove profile formed along an inner diameter of the bearing assembly 14 or the packing element 16.

Figure 5A:
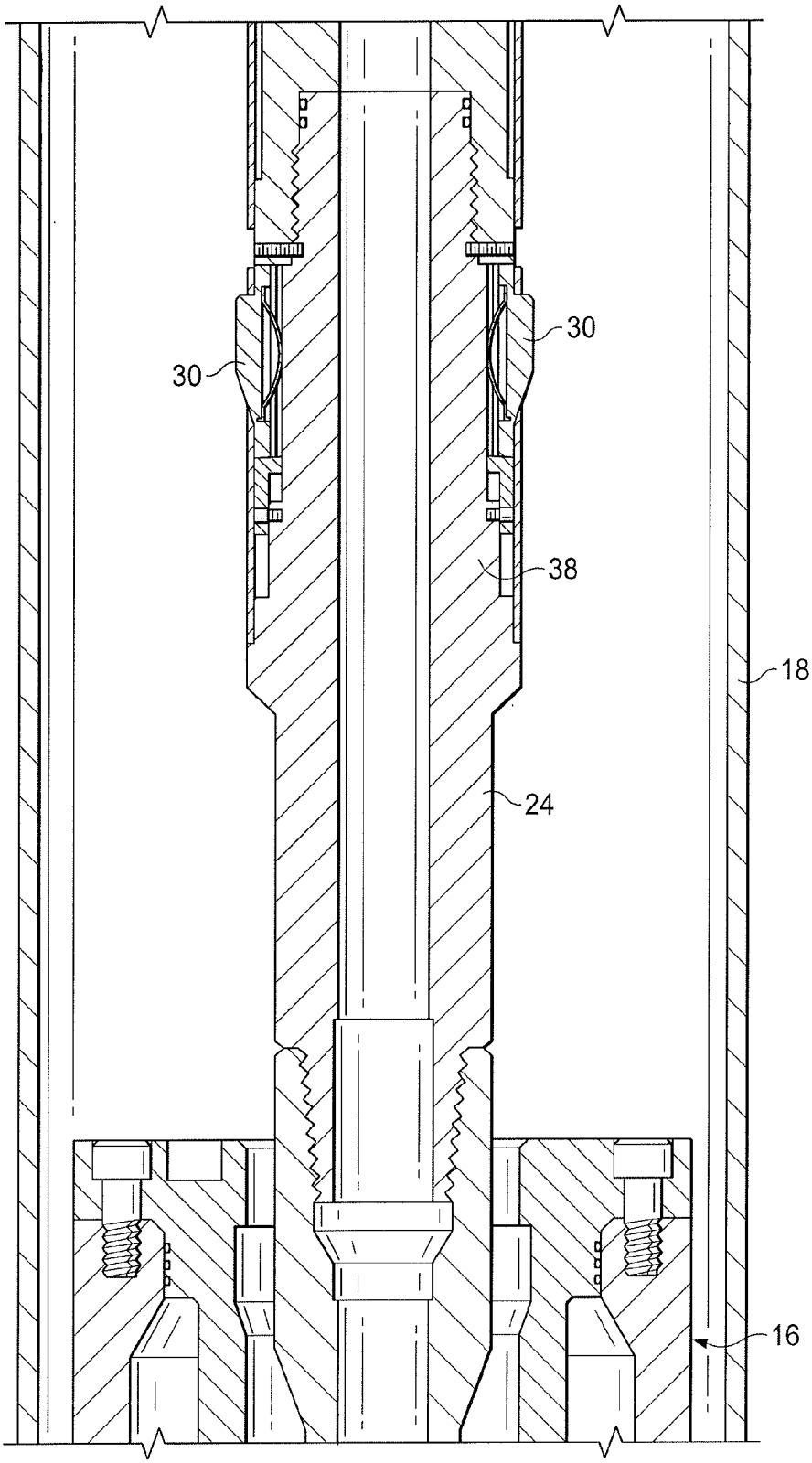
FIGS. 5A-5C are schematic cross sectional views of the pulling tool of FIG. 1 being run into and engaged with a packing element in a RCD, in accordance with an embodiment of the present disclosure.
Figure 5B:
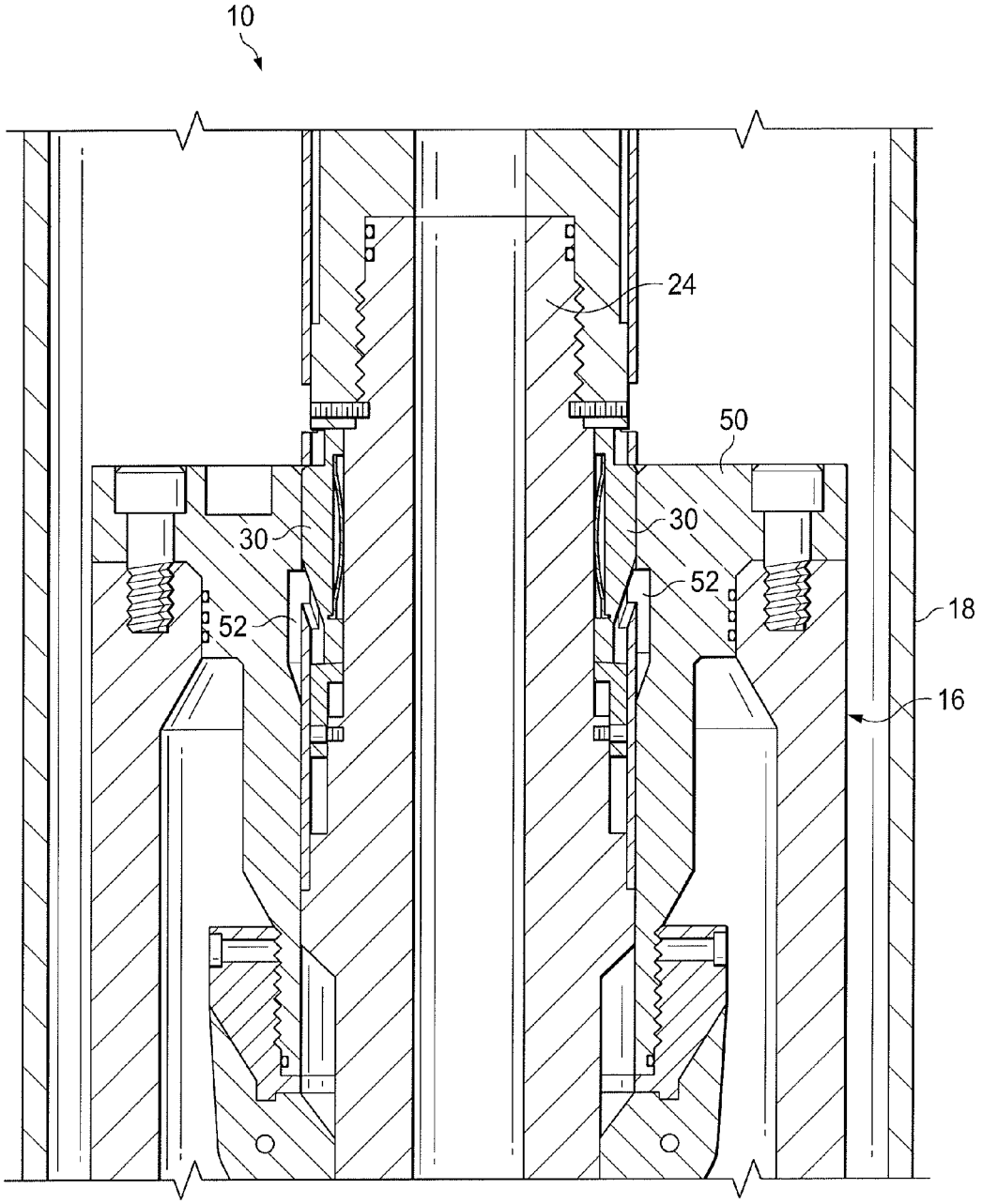
Figure 5C:
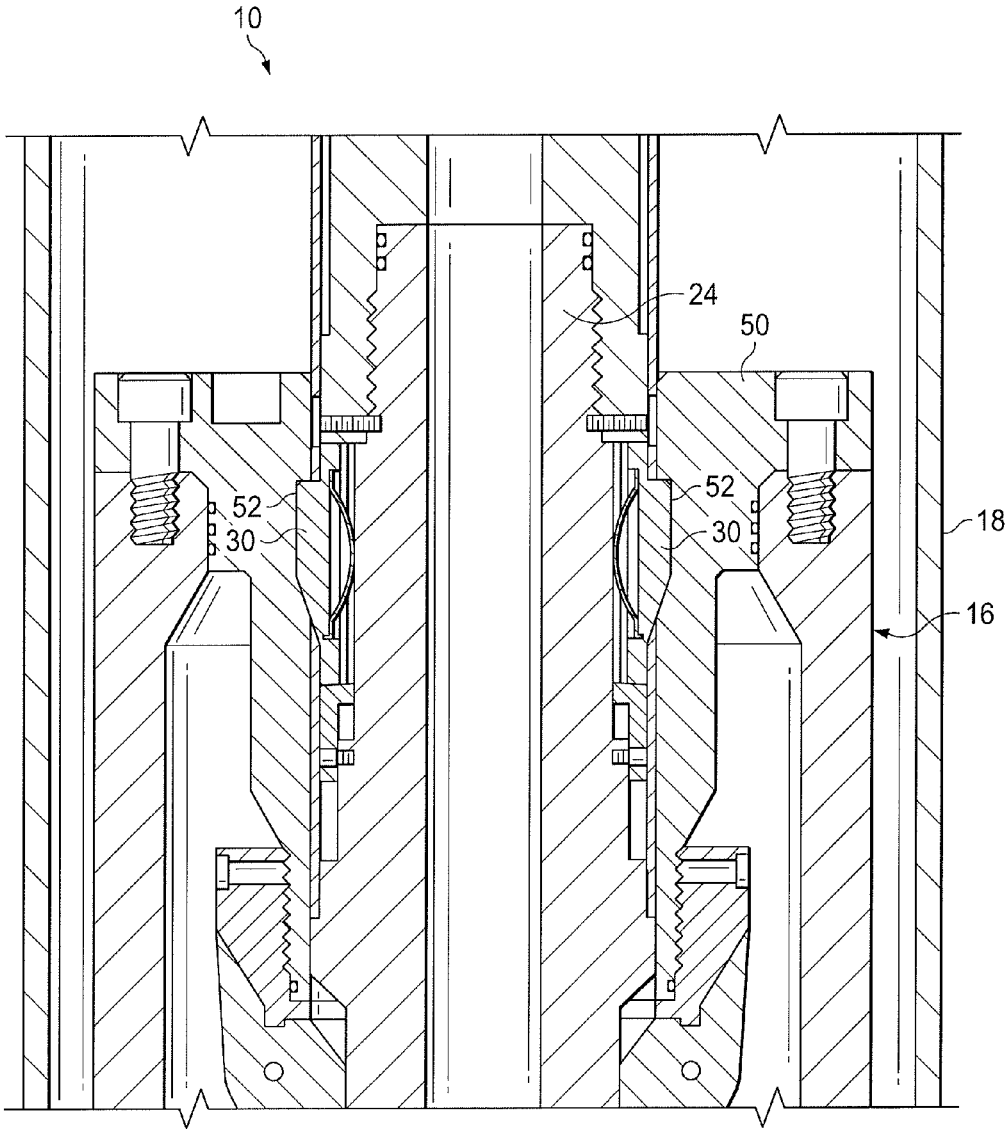

A retrieval operation is illustrated in FIGS. 5A-5C, showing the pulling tool 24 being run into and engaged with an upper stripper housing 50. FIG. 5A shows the pulling tool 24 being lowered into the upper stripper housing 50 positioned in the RCD body 18, with the keys 30 in the extended position. FIG. 5B shows the spring-loaded keys 30 compressed by the inner wall of the upper stripper housing 50 as the pulling tool 24 is lowered. FIG. 5C shows the keys 30 expanding back outward at least partially into a mating internal groove 52 formed along the inner wall of the upper stripper housing 50. As noted above, similar operations may be performed with the pulling tool 24 engaging the bearing assembly 14 instead of the upper stripper housing 50 of the packing element 16.

Figure 6:
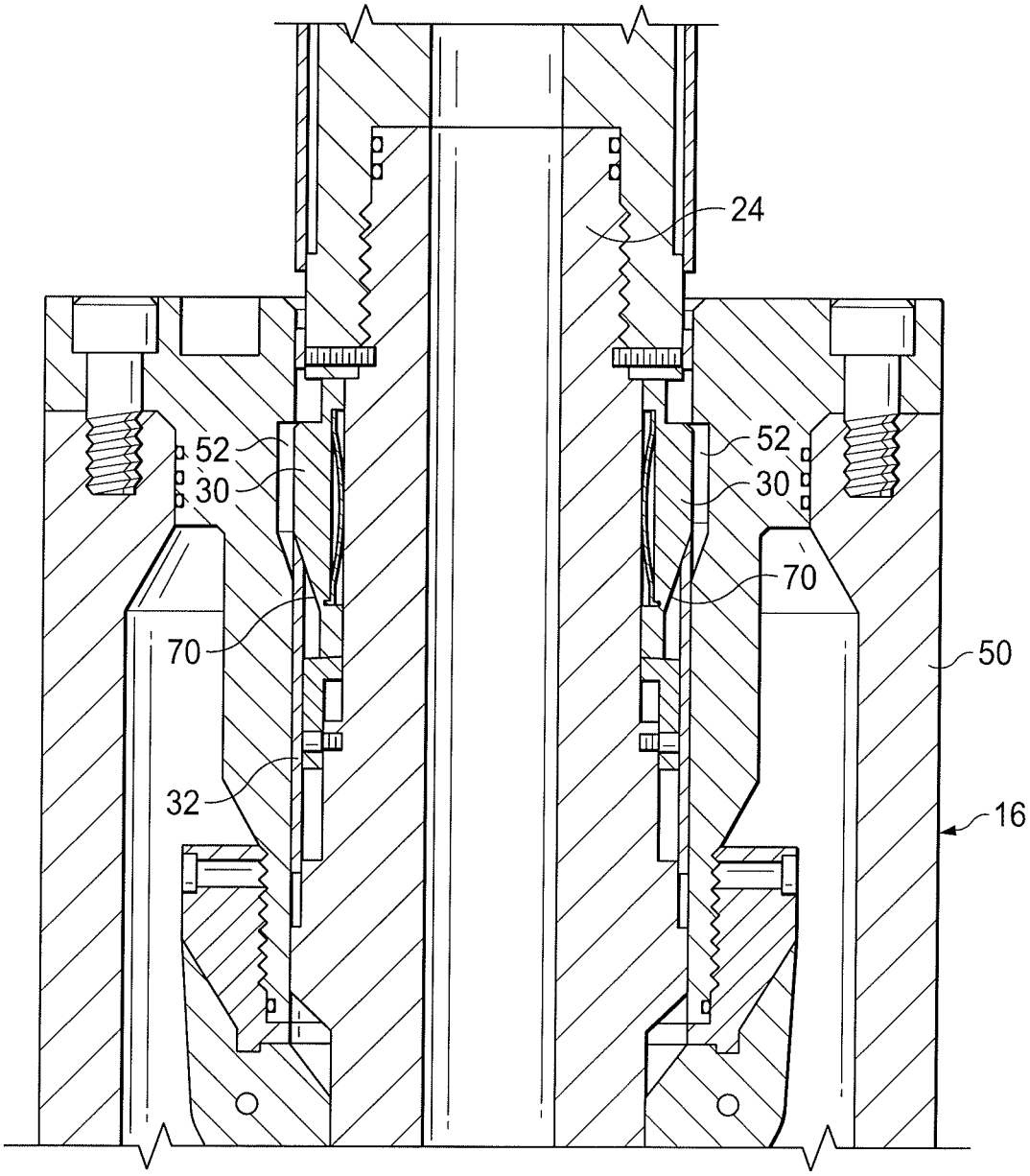
FIG. 6 is a schematic cross sectional view of the pulling tool of FIG. 1 in a packing element with keys retracted, in accordance with an embodiment of the present disclosure.

After engaging the bearing assembly 14 or the upper stripper housing 50, the pulling tool 24 may be lifted out of the RCD 10, thereby pulling the attached RCD component (bearing or packing element) upward through the wellbore and onto the rig floor. The pulling tool 24 may be removed from the bearing assembly 14 or the packing element 16 through retraction of the keys 30 using the outer sleeve 32, as illustrated in FIG. 6. As shown, the outer sleeve 32 may move up relative to the keys 30 and contact a lower angled profile 70 of the keys 30. The net force on the keys 30 may be inwards so that, as the sleeve 32 continues to move up, the keys 30 retract.

Figure 7A:
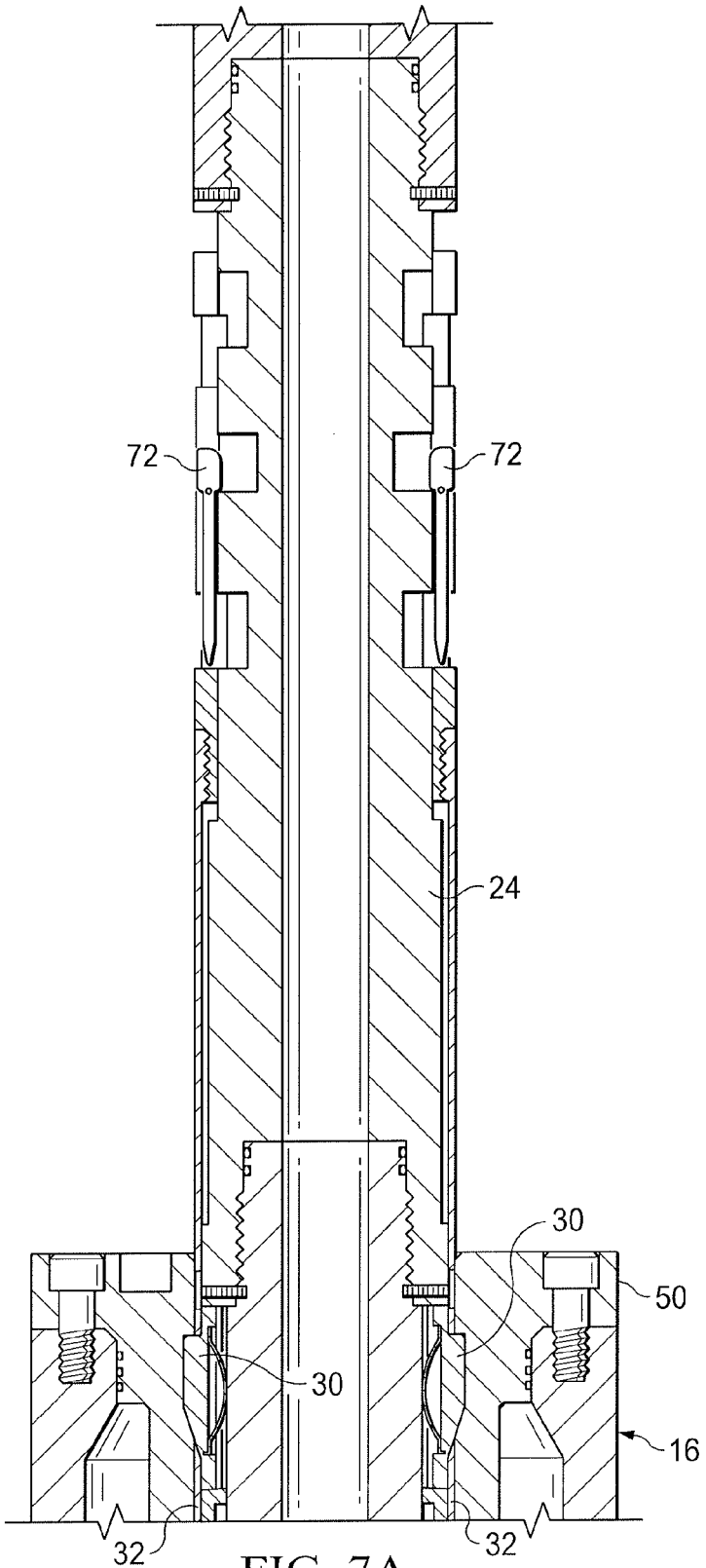
FIGS. 7A-7C are schematic cross sectional views of the pulling tool of FIG. 1 being manually actuated to disengage the pulling tool from a packing element, in accordance with an embodiment of the present disclosure.
Figure 7B:
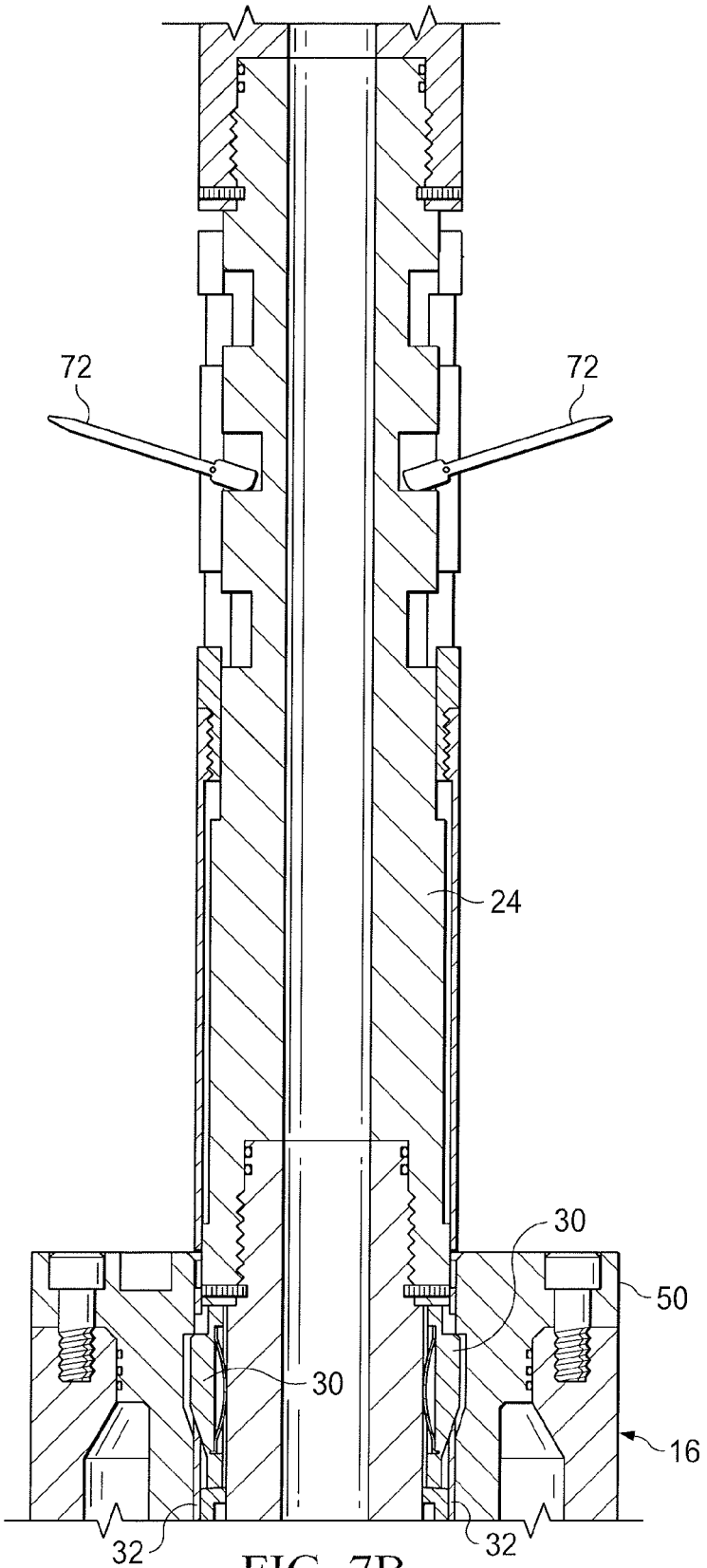
Figure 7C:
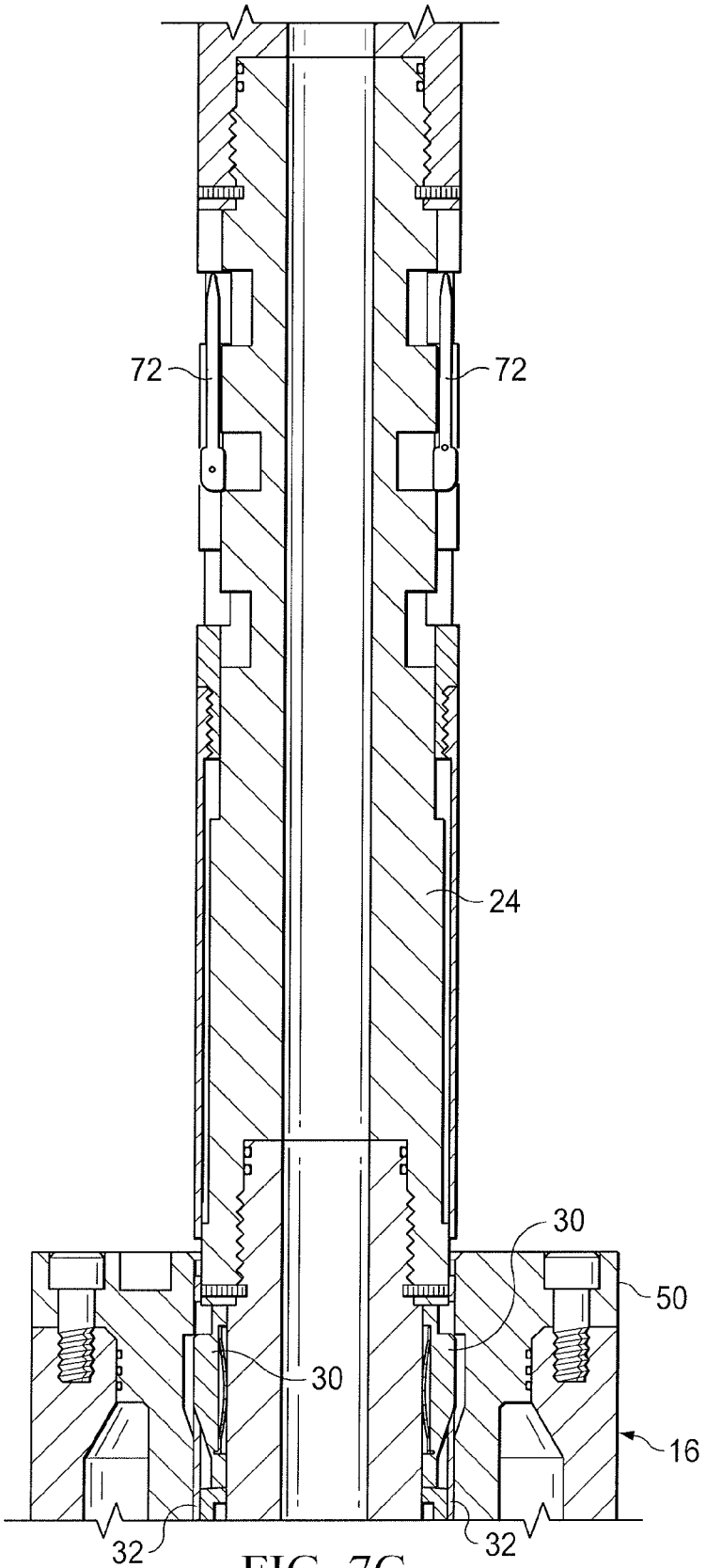

The upward actuation of the outer sleeve 32 to retract the keys 30 may be accomplished in a variety of ways. For example, as illustrated in FIGS. 7A-7C, the outer sleeve 32 may be actuated manually (e.g., at the surface) through the use of two levers 72 that are coupled to or integral to the outer sleeve 32. As illustrated, the levers 72 may be moved from a downward facing position (FIG. 7A) to an upward facing position (FIG. 7C), thereby raising the outer sleeve 32. It should be noted that any desirable number or arrangement of such levers 72 may be utilized to manually actuate the outer sleeve 32 in other embodiments. Furthermore, in some embodiments the outer sleeve 32 may be actuated hydraulically, pneumatically, mechanically, or some combination thereof.

Figure 8A:
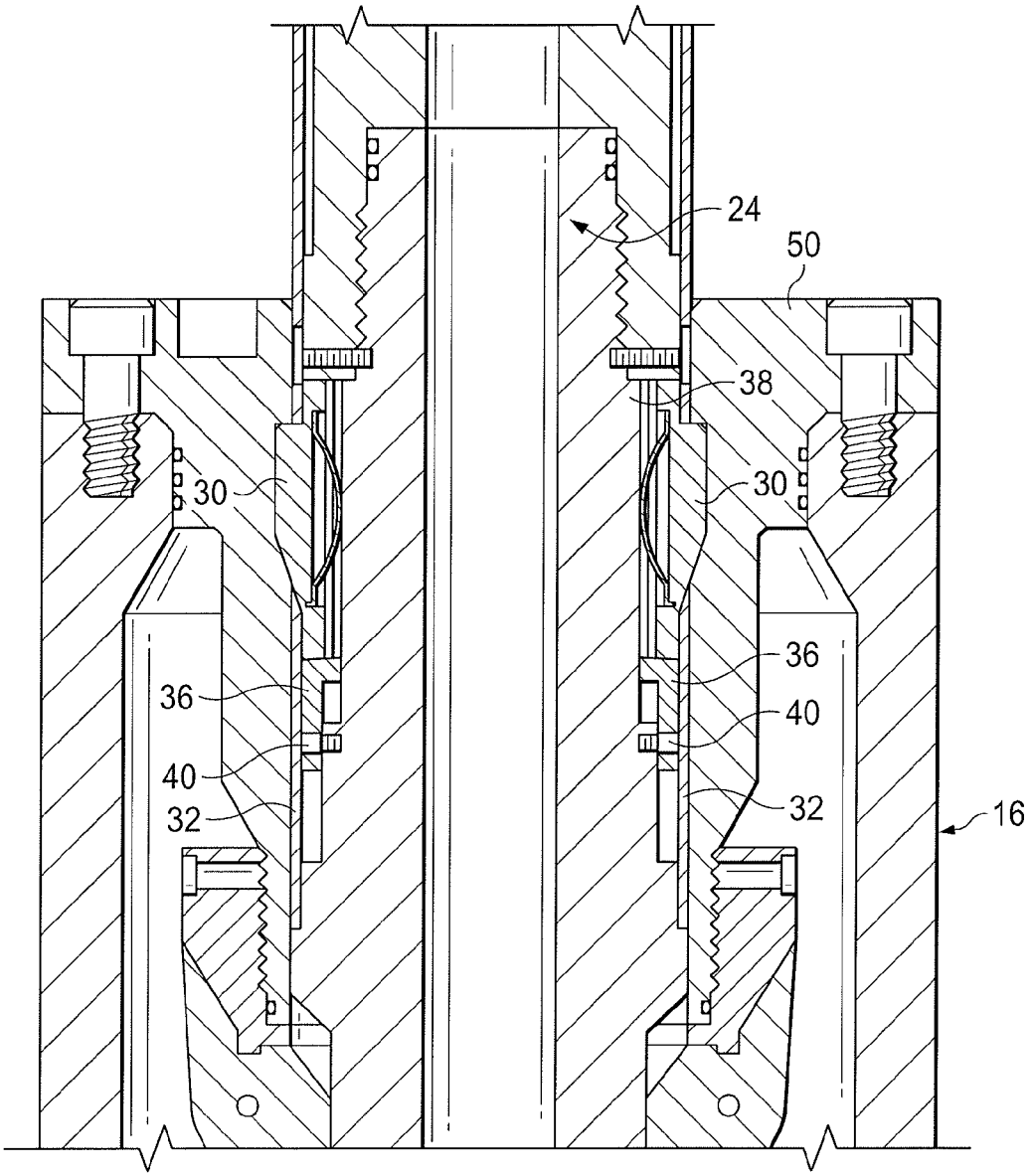
FIGS. 8A-8C are schematic cross sectional views of the pulling tool of FIG. 1 being released from a packing element while the packing element is in a RCD body, in accordance with an embodiment of the present disclosure.
Figure 8B:
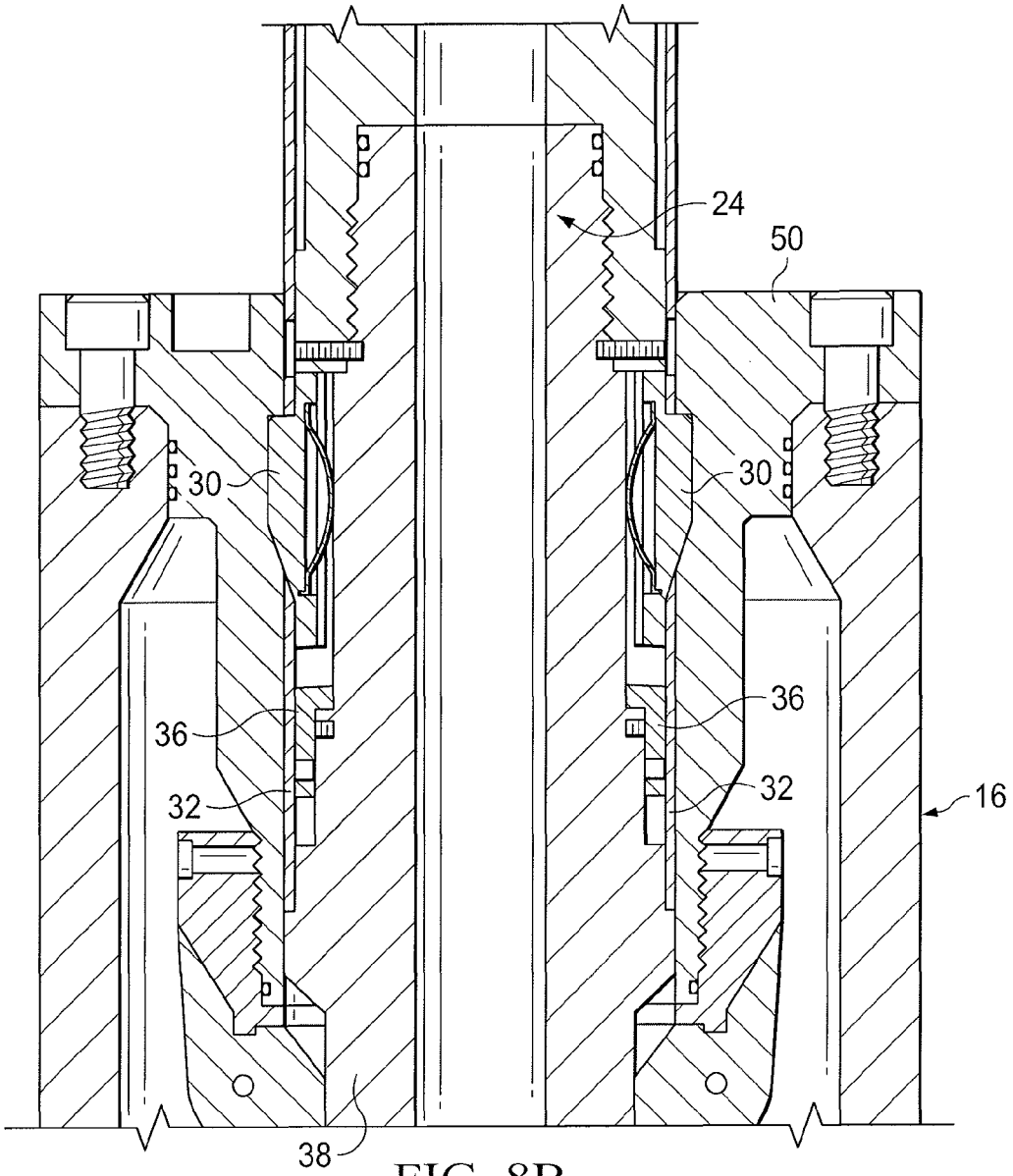
Figure 8C:
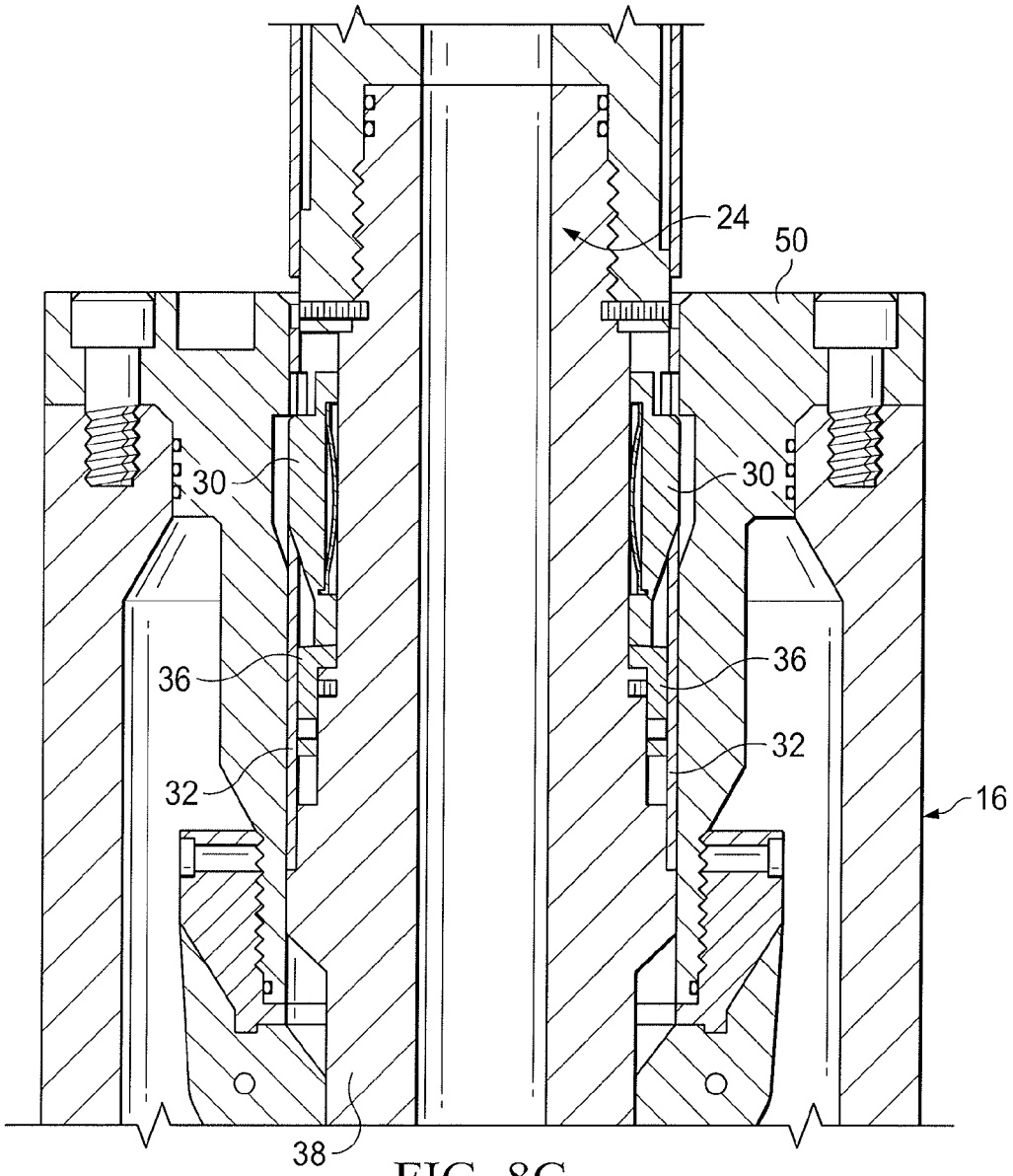

In the event that a mud cake or some other impediment causes the bearing assembly 14 or the upper stripper housing 50 to become stuck in the body 18 of the RCD 10, the pulling tool 24 may be equipped with a mechanism to release the pulling tool 24 from the RCD component while it is in the RCD body 18. This mechanism in operation is illustrated in FIGS. 8A-8C. To release the pulling tool 24, the drill string may overpull the pulling tool 24 by a specified value to shear the pins 40 disposed in the shear sleeve 36 of the pulling tool 24, as shown in FIG. 8A. Overpulling the pulling tool 24 refers to the tubular string applying an upward "pulling" force on a section of the pulling tool 24 when another section (e.g. extended keys 30, sleeve 32, and shear sleeve 36) are held relatively stationary by the stuck downhole equipment (e.g., packing element 16 or bearing assembly 14). As the pulling force is applied to the pulling tool 24, the bottom sub 38 may be pulled relative to the stationary shear sleeve 36. This overpulling of the bottom sub 38 relative to the shear sleeve 36 may cause the pins 40 to shear, thereby releasing the shear sleeve 36 from the bottom sub 38 of the pulling tool 24.

After the shear pins 40 are broken, the shear sleeve 36 may then fall so that it no longer provides support for the keys 30, as illustrated in FIG. 8B. With continued pulling, the outer sleeve 32 and the rest of the pulling tool 24 may move up relative to the stationary keys 30. Since the shear sleeve 36 is no longer supporting the keys 30, this upward movement of the outer sleeve 32 may cause the keys 30 to retract from the mating internal groove 52. This allows the pulling tool 24 to be disengaged from the internal component of the RCD 10 (e.g., bearing assembly 14 or packing element 16) while the internal component is still disposed in the RCD body 18.

The pulling tool 24 may be used to run the bearing assembly 14 or the packing element 16 into the RCD body 18 in a complementary manner as the pulling tool 24 can pull these components. That is, at the surface, the pulling tool 24 may be lowered into the internal component (bearing assembly 14 or packing element 16) until the keys 30 of the pulling tool 24 engage with the mating internal groove 52 of the component. From there, the pulling tool 24, with the attached component, may be lowered into the body 18 of the RCD 10 until the component is properly seated therein. The pulling tool 24 may then disengage from the internal component, via manual actuation of the outer sleeve 32 (e.g., via the levers 72) and/or by shearing the pins 40 to lower the shear sleeve 36.

Figure 9:
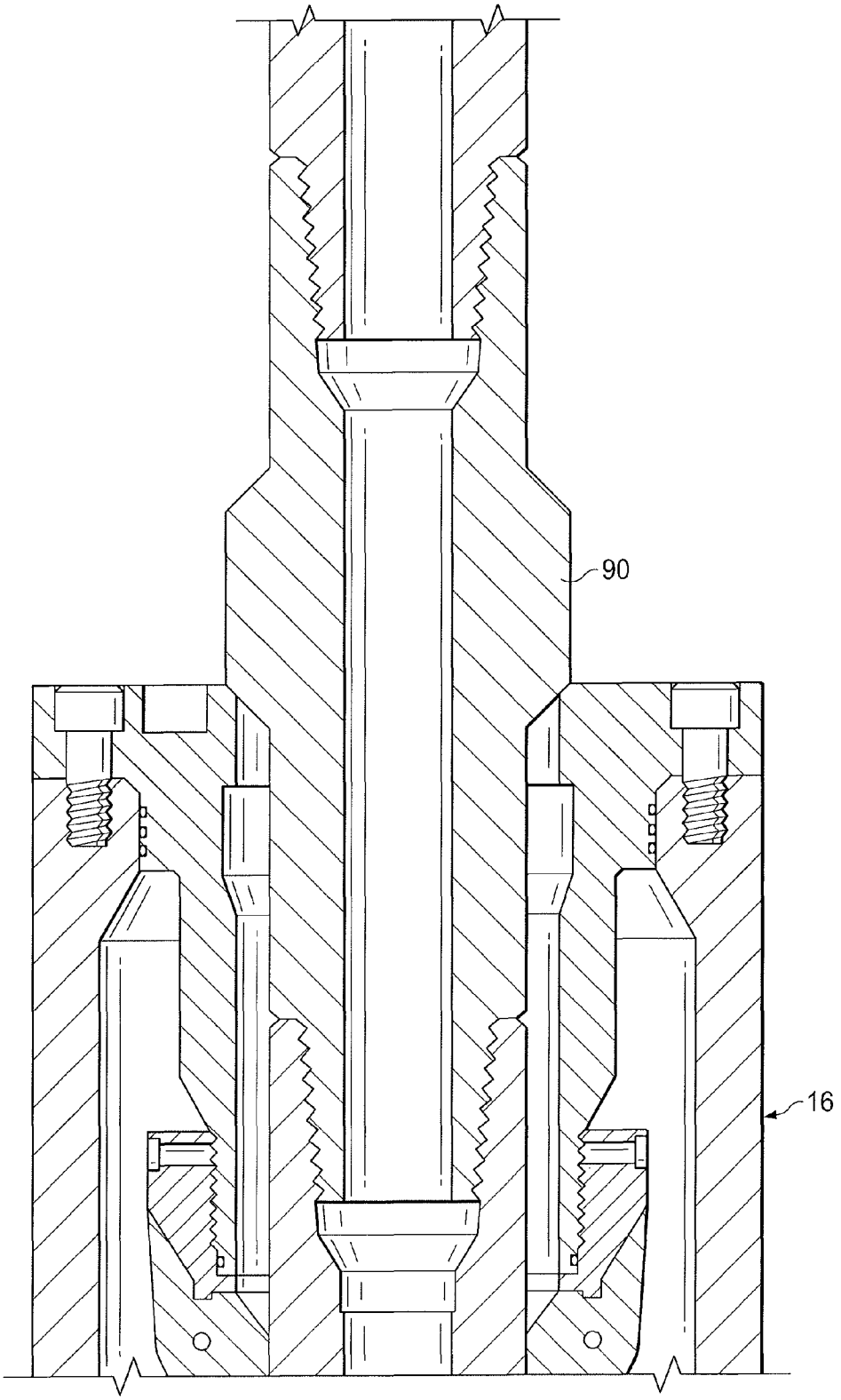
FIG. 9 is a schematic cross sectional view of a packing element being run into a body of a RCD via a no-go sub, in accordance with an embodiment of the present disclosure.

After running the bearing assembly 14 or packing element 16 into the RCD body 18 using the pulling tool 24, the friction between the new element and the body 18 may hold the bearing assembly 14 or the packing element 16 in place. In the event that the bearing assembly 14 or packing element 16 does not fully seat into a shoulder of the RCD body 18, it can be pushed into place, for example with a no-go sub 90 made up to the drill string above the bearing assembly 14 or packing element 16, as illustrated in FIG. 9.

Figure 10:
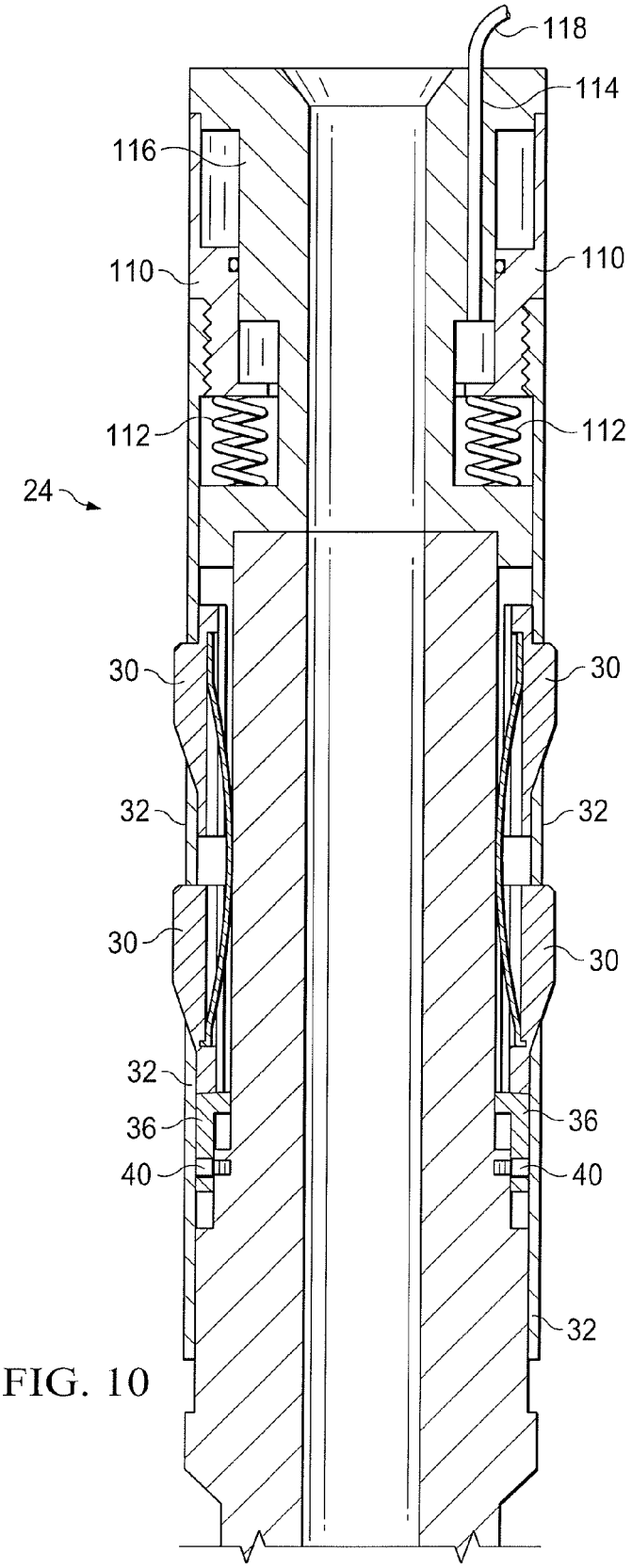
FIG. 10 is a schematic cross sectional view of a pulling tool for selectively running and pulling internal components of a RCD multiple times in one trip, in accordance with an embodiment of the present disclosure.

Another embodiment of the pulling tool 24 is shown in FIG. 10, in which the bearing assembly 14 or the packing element 16 may be both run and pulled several times without the need to reconfigure or redress the pulling tool 24. Specifically, the outer sleeve 32 of this pulling tool 24 may be connected to an annular piston 110, which can be operated hydraulically or pneumatically. The pulling tool 24 may also include a compression spring 112 that exerts an upward force on the piston 110, leaving the keys 30 in a retracted state without the use of hydraulics. When hydraulic pressure is later applied, as illustrated, the piston 110 and the sleeve 32 move down, allowing the keys 30 to extend and engage in the mating internal groove (e.g., 52) of the RCD component. In addition, the pulling tool 24 may include a port 114 in a top sub 116 of the pulling tool 24, and the port 114 may provide communication for fluid pressure via a control line 118 run with the tubular string. In other embodiments of the pulling tool 24, the port 114 may be re-routed through a center sub for pressurization via a pump at the rig, if desired. Still further embodiments of the pulling tool 24 may include different numbers and combinations of the design elements (e.g., piston 110, port 114, shear pins 40, levers 72) described above with reference to FIGS. 4-10.

Embodiments disclosed herein include:

A. A method including lowering a pulling tool into a rotating control device (RCD). The pulling tool includes an outer sleeve, a key extending from the pulling tool through a corresponding opening in the outer sleeve and to an extended position beyond the outer sleeve, and a support sleeve disposed beneath the key and coupled to an internal portion of the pulling tool. The method also includes extending the key into a mating internal groove formed in a RCD internal component to selectively engage the pulling tool with the RCD internal component, and retracting the key into the retracted position to disengage the pulling tool from the RCD internal component.

B. A system including a pulling tool including an outer sleeve, a key, and a support sleeve disposed beneath the key and coupled to an internal portion of the pulling tool. The key is spring-loaded to selectively extend through a corresponding opening in the outer sleeve to an extended position beyond the outer sleeve and into engagement with a mating internal groove of a rotating control device (RCD) internal component for selectively engaging the pulling tool with the RCD internal component. The outer sleeve is movable relative to the key to retract the key into a retracted position for disengaging the pulling tool from the RCD internal component.

C. A system including a body of a rotating control device (RCD), a RCD internal component, and a pulling tool for selectively disposing the RCD internal component into the body and removing the RCD internal component from the body. The pulling tool includes an outer sleeve, a key, and a support sleeve disposed beneath the key and coupled to an internal portion of the pulling tool. The key is spring-loaded to selectively extend through a corresponding opening in the outer sleeve to an extended position beyond the outer sleeve and into engagement with a mating internal groove of the RCD internal component for selectively engaging the pulling tool with the RCD internal component. The outer sleeve is movable relative to the key to retract the key into a retracted position for disengaging the pulling tool from the RCD internal component.

Each of the embodiments A, B, and C may have one or more of the following additional elements in combination. Element 1: further including selectively engaging and disengaging the pulling tool with the RCD internal component without applying a torque to the pulling tool and without providing hydraulic fluid to the pulling tool. Element 2: further including retracting the key into the retracted position as the pulling tool enters the RCD internal component. Element 3: further including lowering the pulling tool into the RCD having the RCD internal component disposed therein, selectively engaging the pulling tool with the RCD internal component at a position within the RCD, and pulling the pulling tool and the RCD internal component out of a body of the RCD. Element 4: further including selectively engaging the pulling tool with the RCD internal component at a position outside the RCD, and running the pulling tool and the RCD internal component into a body of the RCD. Element 5: further including lowering a no-go sub into the RCD to push the RCD internal component into a predetermined position within the body of the RCD. Element 6: further including disengaging the pulling tool from the RCD internal component when the RCD internal component is disposed outside the RCD. Element 7: further including disengaging the pulling tool from the RCD internal component when the RCD internal component is disposed in the RCD. Element 8: wherein disengaging the pulling tool from the RCD internal component includes: shearing a shear pin coupling the support sleeve to the internal portion of the pulling tool, forcing the support sleeve to drop after shearing the shear pin, and lowering the key relative to the outer sleeve until the key is in the retracted position. Element 9: wherein disengaging the pulling tool from the RCD internal component includes forcing the key into the retracted position by moving the outer sleeve upward relative to the key. Element 10: further including actuating the outer sleeve via a manual lever disposed on the pulling tool to move the outer sleeve upward. Element 11: further including actuating the outer sleeve via a hydraulic or pneumatic piston.

Element 12: wherein the support sleeve includes a shear sleeve coupled to the internal portion of the pulling tool via a shear pin. Element 13: wherein the pulling tool further includes at least one lever for manually actuating the outer sleeve relative to the key to retract the key. Element 14: wherein the pulling tool further comprises a hydraulic or pneumatic piston for actuating the outer sleeve relative to the key to selectively extend and retract the key.

Element 15: wherein the RCD internal component includes a bearing assembly for use in the RCD, a packing element for use in the RCD, or both. Element 16: wherein the pulling tool further includes at least one lever for manually actuating the outer sleeve relative to the key to retract the key. Element 17: wherein the support sleeve includes a shear sleeve coupled to the internal portion of the pulling tool via a shear pin for enabling retraction of the key as the pulling tool is removed from the RCD.

Although the present disclosure and its advantages have been described in detail, it should be understood that various changes, substitutions and alterations can be made herein without departing from the spirit and scope of the disclosure as defined by the following claims.

What is claimed is:

1. A method, comprising:

lowering a pulling tool into a rotating control device (RCD), the pulling tool comprising an outer sleeve, a key extending from the pulling tool through a corresponding opening in the outer sleeve and to an extended position beyond the outer sleeve, and a support sleeve disposed beneath the key and coupled to an internal portion of the pulling tool;

extending the key into a mating internal groove formed in a RCD internal component to selectively engage the pulling tool with the RCD internal component; and retracting the key into the retracted position to disengage the pulling tool from the RCD internal component, wherein disengaging the pulling tool from the RCD internal component comprises forcing the key into the retracted position by moving the outer sleeve upward relative to the key.

2. The method of claim 1, further comprising selectively engaging and disengaging the pulling tool with the RCD internal component without applying a torque to the pulling tool and without providing hydraulic fluid to the pulling tool.

3. The method of claim 1, further comprising retracting the key into the retracted position as the pulling tool enters the RCD internal component.

4. The method of claim 1, further comprising:

lowering the pulling tool into the RCD having the RCD internal component disposed therein;

selectively engaging the pulling tool with the RCD internal component at a position within the RCD; and pulling the pulling tool and the RCD internal component out of a body of the RCD.

5. The method of claim 1, further comprising:

selectively engaging the pulling tool with the RCD internal component at a position outside the RCD; and running the pulling tool and the RCD internal component into a body of the RCD.

6. The method of claim 5, further comprising lowering a no-go sub into the RCD to push the RCD internal component into a predetermined position within the body of the RCD.

7. The method of claim 1, further comprising disengaging the pulling tool from the RCD internal component when the RCD internal component is disposed outside the RCD.

8. The method of claim 1, further comprising disengaging the pulling tool from the RCD internal component when the RCD internal component is disposed in the RCD.

9. The method of claim 1, wherein disengaging the pulling tool from the RCD internal component comprises:

shearing a shear pin coupling the support sleeve to the internal portion of the pulling tool;

forcing the support sleeve to drop after shearing the shear pin; and lowering the key relative to the outer sleeve until the key is in the retracted position.

10. The method of claim 1, further comprising actuating the outer sleeve via a manual lever disposed on the pulling tool to move the outer sleeve upward.

11. The method of claim 1, further comprising actuating the outer sleeve via a hydraulic or pneumatic piston.

12. A system, comprising:

a pulling tool comprising an outer sleeve, a key, and a support sleeve disposed beneath the key and coupled to an internal portion of the pulling tool;

wherein the key is spring-loaded to selectively extend through a corresponding opening in the outer sleeve to an extended position beyond the outer sleeve and into engagement with a mating internal groove of a rotating control device (RCD) internal component for selectively engaging the pulling tool with the RCD internal component; and wherein the outer sleeve is movable relative to the key to retract the key into a retracted position for disengaging the pulling tool from the RCD internal component.

13. The system of claim 12, wherein the support sleeve comprises a shear sleeve coupled to the internal portion of the pulling tool via a shear pin.

14. The system of claim 12, wherein the pulling tool further comprises at least one lever for manually actuating the outer sleeve relative to the key to retract the key.

15. The system of claim 12, wherein the pulling tool further comprises a hydraulic or pneumatic piston for actuating the outer sleeve relative to the key to selectively extend and retract the key.

16. A system, comprising:

a body of a rotating control device (RCD);

a RCD internal component; and a pulling tool for selectively disposing the RCD internal component into the body and removing the RCD internal component from the body, wherein the pulling tool comprises an outer sleeve, a key, and a support sleeve disposed beneath the key and coupled to an internal portion of the pulling tool;

wherein the key is spring-loaded to selectively extend through a corresponding opening in the outer sleeve to an extended position beyond the outer sleeve and into engagement with a mating internal groove of the RCD internal component for selectively engaging the pulling tool with the RCD internal component; and wherein the outer sleeve is movable relative to the key to retract the key into a retracted position for disengaging the pulling tool from the RCD internal component.

17. The system of claim 16, wherein the RCD internal component comprises a bearing assembly for use in the RCD, a packing element for use in the RCD, or both.

18. The system of claim 16, wherein the pulling tool further comprises at least one lever for manually actuating the outer sleeve relative to the key to retract the key.

19. The system of claim 16, wherein the support sleeve comprises a shear sleeve coupled to the internal portion of the pulling tool via a shear pin for enabling retraction of the key as the pulling tool is removed from the RCD.

* * * * *